US011670150B2

(12) United States Patent
Muro

(10) Patent No.: US 11,670,150 B2
(45) Date of Patent: Jun. 6, 2023

(54) HEAT SENSOR AND SMOKE AND HEAT FIRE DETECTOR

(71) Applicant: Panasonic Intellectual Property Management Co., Ltd., Osaka (JP)

(72) Inventor: Naoki Muro, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/619,129

(22) PCT Filed: May 25, 2020

(86) PCT No.: PCT/JP2020/020603
§ 371 (c)(1),
(2) Date: Dec. 14, 2021

(87) PCT Pub. No.: WO2020/250659
PCT Pub. Date: Dec. 17, 2020

(65) Prior Publication Data

US 2022/0358820 A1 Nov. 10, 2022

(30) Foreign Application Priority Data

Jun. 14, 2019 (JP) ..... JP2019-111535

(51) Int. Cl.
*G08B 17/06* (2006.01)
*G08B 17/10* (2006.01)

(52) U.S. Cl.
CPC ..... *G08B 17/06* (2013.01); *G08B 17/10* (2013.01)

(58) Field of Classification Search
CPC ..... G08B 17/06; G08B 17/10
See application file for complete search history.

(56) References Cited

U.S. PATENT DOCUMENTS

2003/0058116 A1 3/2003 Mayusumi et al.
2008/0246618 A1* 10/2008 Siber ..... G08B 17/10 340/577
2015/0379845 A1* 12/2015 Fischer ..... G08B 17/06 250/338.3

FOREIGN PATENT DOCUMENTS

JP H10-188163 A 7/1998
JP 2002-352345 A 12/2002
(Continued)

OTHER PUBLICATIONS

Extended European Search Report dated Jul. 13, 2022 issued in the corresponding European Patent Application No. 20821996.4.
(Continued)

*Primary Examiner* — Ojiako K Nwugo
(74) *Attorney, Agent, or Firm* — McDermott Will & Emery LLP

(57) ABSTRACT

A heat sensor includes a base and a heat sensor body. The base is to be mounted onto a mounting surface of a building. The heat sensor body has a bottomed cylindrical shape and is to be attached to the base. The heat sensor body includes an opening, a board, a heat detection unit, and at least one wall member. The at least one wall member controls flow of a gas to cause the gas that passed through the opening to flow toward the heat detection unit. The at least one wall member separates the flow of the gas that has entered the heat sensor body from an external space through the opening into a plurality of gas flows and directs one of the plurality of gas flows, which has been separated to flow beside an inner surface of the heat sensor body, toward the heat detection unit.

12 Claims, 7 Drawing Sheets

(56) References Cited

FOREIGN PATENT DOCUMENTS

| | | | |
|---|---|---|---|
| JP | 2003-109142 | A | 4/2003 |
| JP | 4066761 | B2 | 3/2008 |
| JP | 2009-211613 | A | 9/2009 |
| JP | 2009-230510 | A | 10/2009 |
| JP | 2011-192244 | A | 9/2011 |

OTHER PUBLICATIONS

International Search Report and Written Opinion issued in International Patent Application No. PCT/JP2020/020603, dated Jul. 21, 2020; with partial English translation.
Notice of Reasons for Refusal dated Mar. 14, 2023 issued in the corresponding Japanese Patent Application No. 2021-525971, with English translation.

* cited by examiner

HEAT SENSOR AND SMOKE AND HEAT FIRE DETECTOR

CROSS-REFERENCE OF RELATED APPLICATIONS

This application is the U.S. National Phase under 35 U.S.C. § 371 of International Patent Application No. PCT/JP2020/020603, filed on May 25, 2020, which in turn claims the benefit of Japanese Application No. 2019-111535, filed on Jun. 14, 2019, the entire disclosures of which Applications are incorporated by reference herein.

TECHNICAL FIELD

The present disclosure generally relates to a heat sensor and a smoke and heat fire detector (hereinafter simply referred to as a "smoke and heat detector"), and more particularly relates to a heat sensor and smoke and heat detector for sensing heat generated by a fire, for example.

BACKGROUND ART

Patent Literature 1 discloses a fire detector including: a heat detection unit for detecting heat based on hot air produced at the outbreak of a fire; a sensor body provided with the heat detection unit; and an outer cover for protecting the heat detection unit. The outer cover includes a plurality of plate-shaped fins arranged around the heat detection unit. The plurality of plate-shaped fins are arranged to define a predetermined offset angle with respect to a direction pointing toward the center of the outer cover and to stand substantially upright with respect to the sensor body. This allows the hot air produced by a fire to be concentrated by the plurality of plate-shaped fins as an eddy flow toward the center of the outer cover.

According to Patent Literature 1, however, such an eddy flow is formed by the plate-shaped fins, thus often causing a gas inside the plate-shaped fins to flow a longer distance (such a distance will be hereinafter referred to as a "gas flow length"). Thus, the heat of the gas flowing inside the sensor body toward the heat detection unit tends to be lowered by some members provided inside the plate-shaped fins. Consequently, even if the temperature is actually high enough to make a decision that a fire should be present, the temperature sensed might be still low enough to make an erroneous decision that no fire should be present yet.

CITATION LIST

Patent Literature

Patent Literature 1: JP 2003-109142 A

SUMMARY OF INVENTION

The problem to be overcome by the present disclosure is to provide a heat sensor and smoke and heat fire detector, both of which may reduce the chances of excessively lowering the heat of a gas flowing toward the heat detection unit.

A heat sensor according to an aspect of the present disclosure includes a base and a heat sensor body. The base is to be mounted onto a mounting surface of a building. The heat sensor body has a bottomed cylindrical shape and is to be attached to the base. The heat sensor body includes an opening, a board, a heat detection unit, and at least one wall member. The opening is provided through a side surface of the bottomed cylindrical shape of the heat sensor body and communicates with an external space. The board is housed in the vicinity of a bottom surface of the bottomed cylindrical shape of the heat sensor body to face the bottom surface. The heat detection unit is mounted on an end portion of the board to detect heat of a gas flowing in from the external space. The at least one wall member controls flow of the gas to cause the gas that passed through the opening to flow toward the heat detection unit. The at least one wall member separates the flow of the gas that has entered the heat sensor body from the external space through the opening into a plurality of gas flows and directs one of the plurality of gas flows, which has been separated to flow beside an inner surface of the heat sensor body, toward the heat detection unit.

A smoke and heat fire detector according to another aspect of the present disclosure includes a smoke detection unit to determine whether or not a fire is present by sensing, in a space inside a stray light attenuating labyrinth structure, a smoke component that has entered the heat sensor body as a component of the gas. The smoke detection unit is provided close to a center of the board of the heat sensor so as to avoid interfering with the heat detection unit and the wall member. The smoke and heat fire detector determines, based on at least one of a result of detection obtained by the smoke detection unit or a result of detection obtained by the heat detection unit, whether or not a fire is present.

DESCRIPTION OF EMBODIMENTS (1) Overview

The drawings to be referred to in the following description of embodiments are all schematic representations. That is to say, the ratio of the dimensions (including thicknesses) of respective constituent elements illustrated on the drawings does not always reflect their actual dimensional ratio.

A heat sensor 1 according to an exemplary embodiment may be implemented as, for example, a fire detector, which includes a heat detection unit 3 for detecting heat generated by a fire, for example. In other words, the heat sensor 1 is a sensor having at least the capability of detecting heat. In the following description, the heat sensor 1 is supposed to be a so-called "smoke and heat detector" (see FIGS. 1-6) in which the heat sensor 1 further includes a smoke detection unit 4 (see FIG. 1). Optionally, the heat sensor 1 may include, instead of, or in addition to, the smoke detection unit 4, a detection unit for detecting, for example, the presence of a flame, gas leakage, or carbon monoxide (CO)

produced by imperfect combustion. Alternatively, the detection unit of the heat sensor 1 may consist of only the heat detection unit 3. In that case, the heat sensor 1 has only the capability of detecting heat.

Figure 2:
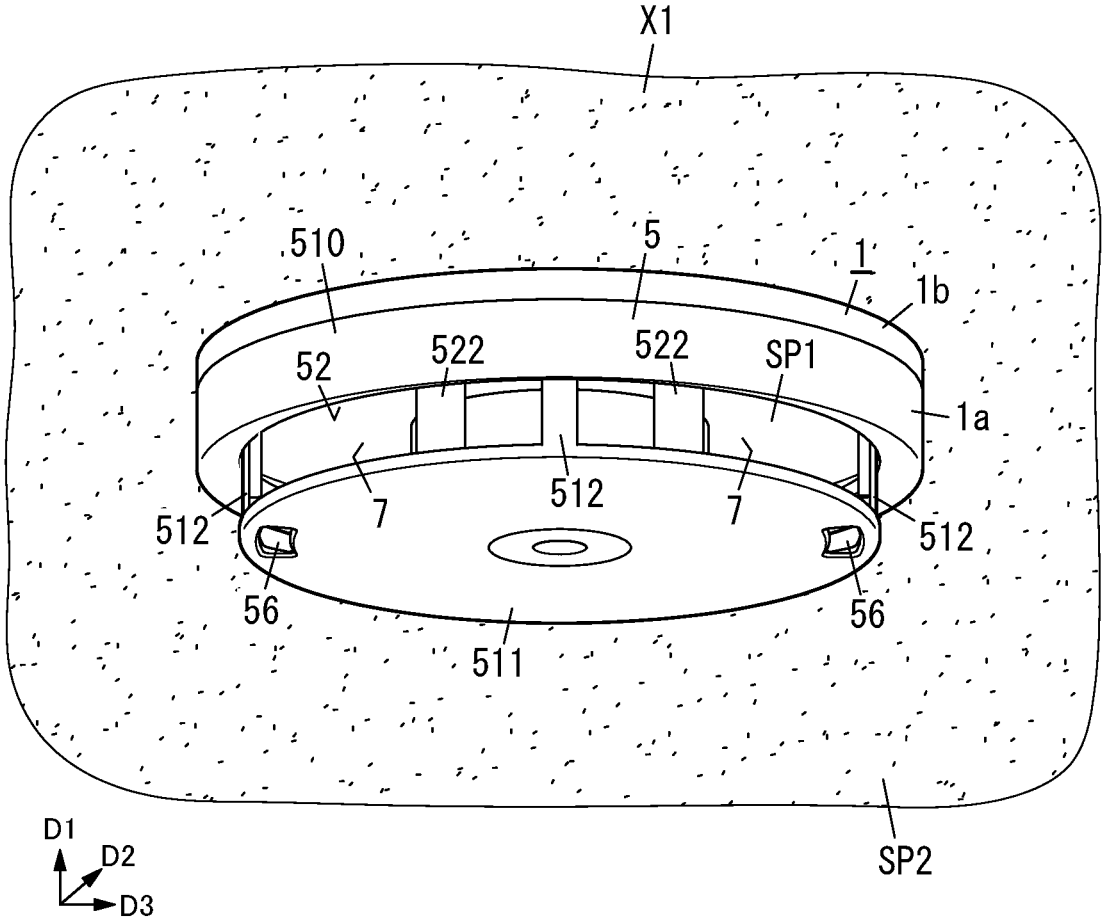
FIG. 2 is a perspective view of the heat sensor as viewed from below the heat sensor.

As shown in FIG. 2, the heat sensor 1 is installed on a mounting surface X11 of a structural component X1 (e.g., a ceiling in the example illustrated in FIG. 2), which is a building component such as the ceiling or a wall of a building, for example, by screwing with screws, affixing with an adhesive material, or hooking and sandwiching, with spring biasing force, a protruding piece that engages with a hole of the mounting surface X11. In this embodiment, the mounting surface X11 may be a lower surface of the ceiling, for example.

Figure 1:
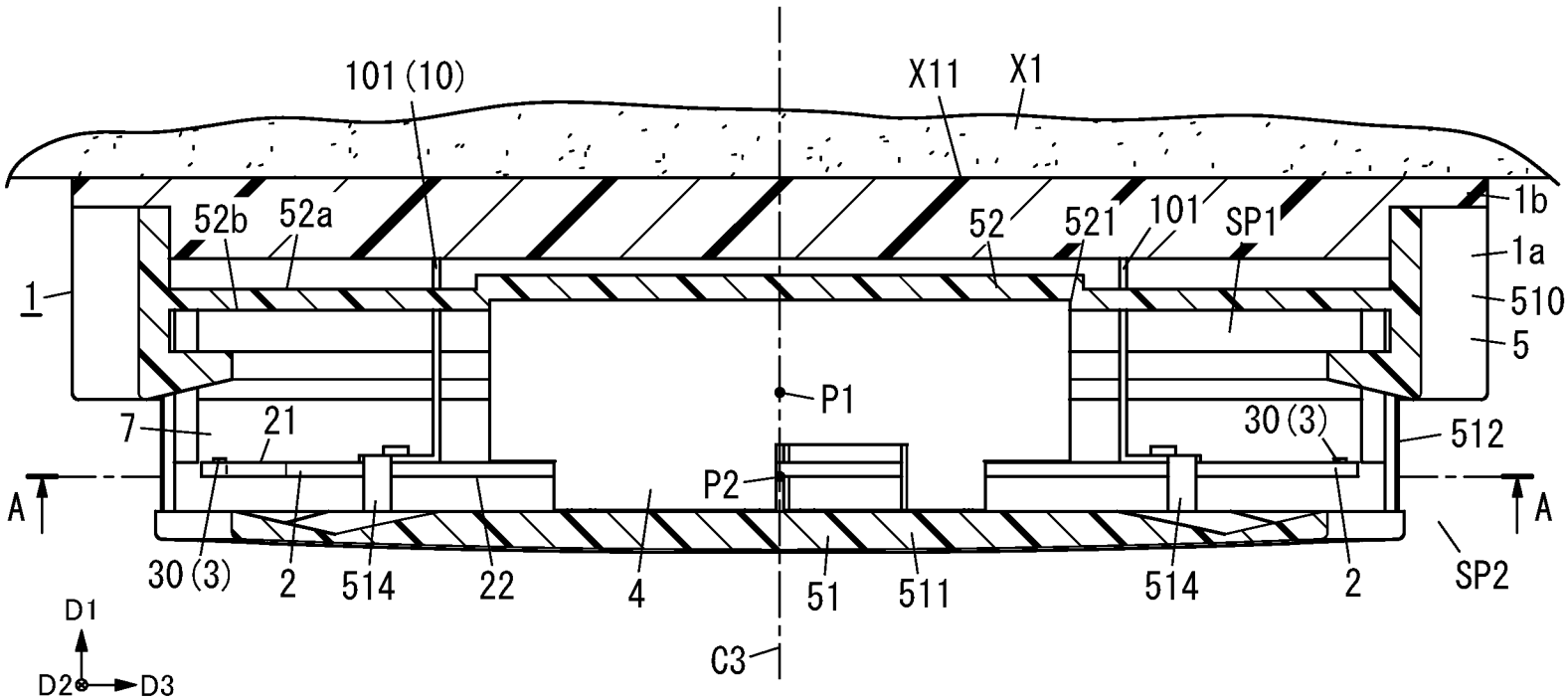
FIG. 1 is a cross-sectional view of a heat sensor according to an exemplary embodiment.

As shown in FIG. 1, the heat sensor 1 includes a base 1*b* and a heat sensor body 1*a*. The base 1*b* is to be mounted onto the mounting surface X11 of a building. The heat sensor body 1*a* has a bottomed cylindrical shape and is to be attached to the base 1*b*. The heat sensor body 1*a* includes a board 2, an opening 7, a heat detection unit 3, and at least one wall member 522. The opening 7 is provided through a side surface of the bottomed cylindrical shape of the heat sensor body 1*a* and communicates with an external space SP2. The board 2 is housed in the vicinity of a bottom surface of the bottomed cylindrical shape of the heat sensor body 1*a* to face the bottom surface. The heat detection unit 3 is mounted on an end portion of the board 2 to detect heat of a gas flowing in from the external space SP2 outside of the heat sensor body 1*a*. The at least one wall member 522 controls the flow 64 of the gas to cause the gas that passed through the opening 7 to flow toward the heat detection unit 3. The at least one wall member 522 separates the flow 63 of the gas that has entered the heat sensor body 1*a* from the external space SP2 through the opening 7 into a plurality of gas flows 64, 65 (see FIG. 3). In addition, the at least one wall member 522 also directs one gas flow 64, which has been separated to flow beside an inner surface of the heat sensor body 1*a*, out of the plurality of gas flows 64, 65, toward the heat detection unit 3.

In the heat sensor 1 with such a configuration, the gas flow 63 directed toward the wall member 522 is controlled by the wall member 522 to turn into a gas flow 64 directed toward the heat detection unit 3. In addition, the length of the gas flow 64 directed toward the heat detection unit 3 may be shortened between the wall member 522 and the heat detection unit 3. This may reduce the chances of lowering the heat of the gas directed from the wall member 522 toward the heat detection unit 3, thus shortening the time it takes for the heat sensor 1 to detect the presence of a fire.

(2) Details (2.1) Overall Configuration

Next, an overall configuration of the heat sensor 1 according to this embodiment will be described in detail. The heat sensor 1 shown in FIG. 1 is implemented as a so-called "smoke and heat detector" for detecting both smoke and heat as described above.

In the following description, the heat sensor 1 is supposed to be installed on a ceiling surface (i.e., the mounting surface X11) as in the example illustrated in FIG. 2. Thus, the arrangement direction D1 in which the base 1*b* and the heat sensor body 1*a* are arranged will be hereinafter referred to as an "upward/downward direction." The direction D2 perpendicular to the arrangement direction D1 will be hereinafter referred to as a "rightward/leftward direction." The direction perpendicular to the direction D2 will be hereinafter referred to as a "forward/backward direction." Note that the arrows indicating the upward/downward direction, the rightward/leftward direction, and the forward/backward direction are shown on the drawings just as an assistant to description and are insubstantial ones. In addition, these directions should not be construed as limiting the directions in which the heat sensor 1 is used. Alternatively, these directions D1, D2, D3 may also be simply regarded as first, second, and third directions, respectively.

As shown in FIG. 1, the heat sensor 1 includes the base 1*b* and the heat sensor body 1*a*.

The heat sensor body 1*a* is provided to be out of contact with the mounting surface X11 when attached to the base 1*b*. The heat sensor body 1*a* includes a housing 5, a board 2, a heat detection unit 3, a smoke detection unit 4 (of a photoelectric type and with a labyrinth for attenuating stray light), and a plurality of mounting members 10 (see FIG. 1). The heat sensor body 1*a* further includes a wall member 522 (see FIGS. 2 and 3). The heat sensor body 1*a* further includes a control unit 9 and a communications unit 11 (see FIG. 5). The communications unit 11 transmits, when the heat sensor 1 senses at least heat, a signal serving as an alert to the presence of the heat to an external alarm device (not shown) or any other device, and receives a signal from the alarm device, for example. The heat sensor 1 may be supplied with power from a commercial power supply via the mounting members 10. Alternatively, if the communications unit 11 is a wireless one, then a battery, not the commercial power supply, may be used as a power supply to supply power to respective components to be driven with the power. If two or more fire detectors are used as wireless ones and are arranged at relative positions at which sufficient wireless signal strengths are obtained, then there is no need to extend electric wires from the commercial power supply. Thus, such fire detectors may be easily installed afterward into a building that has already been established.

(2.2) Base

The base 1*b* is a disklike one to be mounted onto the mounting surface X11 of the structural component X1 with screws, for example, as shown in FIG. 1. When the base 1*b* is mounted onto the mounting surface X11, the heat sensor body 1*a* is attached to the base 1*b*. Thus, this base 1*b* is also called an "attachment base." In addition, the base 1*b* is attachable to, and removable from, the heat sensor body 1*a*. When the heat sensor body 1*a* is attached to such a base 1*b*, an upper end portion of the housing 5 will be in contact with a side surface of the base 1*b* and mounting members 10 will be attached onto the base 1*b*. The base 1*b* suitably includes a connecting portion enabling the mounting members 10 to be connected thereto when the mounting members 10 are attached onto the base 1*b*. The connecting portion may be electrically connected to not only the commercial power supply if power is supplied via cables but also the mounting members 10 as well.

(2.3) Heat Sensor Body

Figure 3:
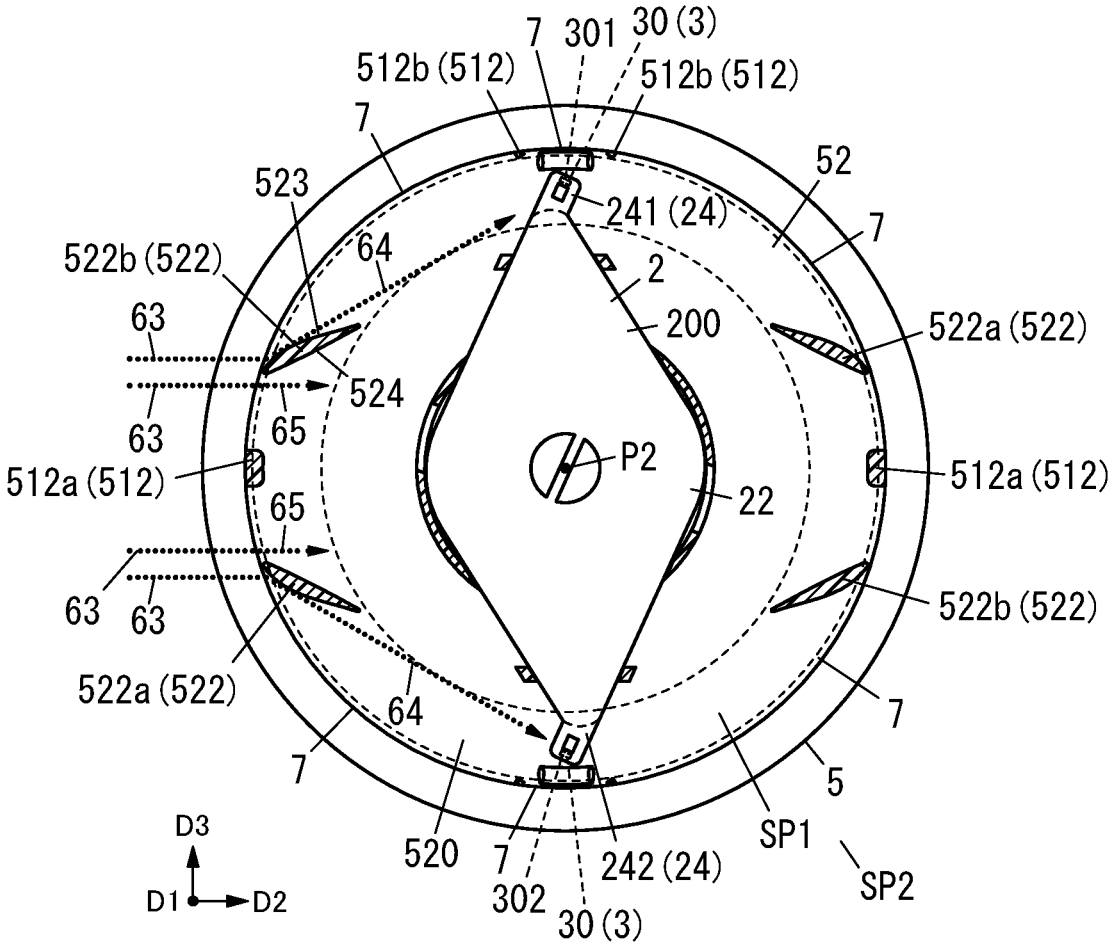
FIG. 3 is a cross-sectional view thereof taken along the plane A-A shown in FIG. 1.

The heat sensor body 1*a* includes the housing 5 as described above. The housing 5 defines the shape of the heat sensor body 1*a* and encloses the board 2, the heat detection unit 3, the smoke detection unit 4, the wall member 522, and the internal space SP1 inside (see FIGS. 1 and 3) The housing 5 has a plurality of (e.g., six) openings 7 that allows the internal space SP1 to communicate with the external space SP2 outside of the housing 5 as shown in FIG. 3. The heat detection unit 3 is mounted on an end portion (i.e., an extended portion 24 to be described later) of the board 2.

In this embodiment, when a gas is heated by a fire, for example, to produce a flow 63 directed toward the wall member 522, the wall member 522 controls the flow 63 such that the gas that has passed through the opening 7 flows toward the heat detection unit 3 as shown in FIG. 3. In addition, the wall member 522 separates the flow 63 that has entered the heat sensor body 1*a* from the external space SP2 through the opening 7 into a plurality of gas flows 64, 65. As a result, a first flow 64 of the gas directed toward the heat detection unit 3 and a second flow 65 of the gas directed toward another member such as the smoke detection unit 4 are produced in the internal space SP1. In other words, the gas 63 is separated into the first flow 64 running close to an inner surface (i.e., a surface facing the internal space SP1) of the bottomed cylindrical shape of the heat sensor body 1*a* and the second flow 65 running distant from the inner surface when viewed from the wall member 522. Then, out of the gas flows 64, 65 that have been separated by the wall member 522, the first flow 64 runs closer to the inner surface of the heat sensor body 1*a* and is guided more easily toward the heat detection unit 3, than the second flow 65. Meanwhile, out of the gas flows 64, 65 that have been separated by the wall member 522, the second flow 65 runs more distant from the inner surface of the heat sensor body 1*a* and is less likely to be directed toward the heat detection unit 3, than the first flow 64.

In the following description, the gas heated by a fire, for example, will be hereinafter referred to as "hot air." In FIG. 3, the flows 63, 64, 65 are schematically indicated by the dotted arrows to make the hot air flows more easily understandable. Out of the first and second flows 64, 65 in the internal space SP1, the first flow 64 is produced as a linear flow directed toward the heat detection unit 3, and therefore, may have a shortened length between the wall member 522 and the heat detection unit 3. Therefore, the first flow 64 of the hot air is less likely cooled between the wall member 522 and the heat detection unit 3, thus shortening the time it takes for the heat sensor 1 to detect the presence of a fire. That is to say, this allows the heat sensor 1 to detect the presence of a fire more accurately. Meanwhile, the second flow 65 of the hot air could be cooled by other members such as the smoke detection unit 4. Nevertheless, the second flow 65 of the hot air is obstructed by those other members, and therefore, is hardly directed toward the heat detection unit 3.

The housing 5 houses the board 2, the heat detection unit 3, the smoke detection unit 4, the wall member 522, the control unit 9, the communications unit 11, and other circuit modules inside.

The housing 5 is made of a synthetic resin and may be made of flame-retardant ABS resin, for example. As shown in FIG. 1, the housing 5 includes: a bottomed cylindrical front cover 51, of which one surface (e.g., an upper surface in the example illustrated in FIG. 1) is open; and a disklike cap member (back cover) 52. In this embodiment, the front cover 51 specifically has a circular cylindrical shape. The back cover 52 is provided between the base 1*b* and the board 2 in the arrangement direction D1. The back cover 52 covers the board 2, the heat detection unit 3, the smoke detection unit 4, the wall member 522, and other members on the opposite side from the front cover 51. The back cover 52 has a first surface 52*a* and a second surface 52*b* parallel to the first surface 52*a*. The first and second surfaces 52*a*, 52*b* intersect with the arrangement direction D1. The first surface 52*a* is an upper surface and the second surface 52*b* is a lower surface. In addition, the first surface 52*a* faces the base 1*b* when the heat sensor body 1*a* is attached to the base 1*b* (see FIG. 1).

The wall member 522 is provided between a base portion 511 of the front cover 51 and the back cover 52 (see FIG. 2). For example, the upper end of the wall member 522 faces the back cover 52 and the lower end of the wall member 522 faces the base portion 511. Optionally, the upper end of the wall member 522 may be in contact with the back cover 52 and the lower end thereof may be in contact with the base portion 511.

When the heat sensor body 1*a* is viewed in the arrangement direction D1, the wall member 522 and the heat detection unit 3 are located along a peripheral edge portion 520 of the back cover 52 (see FIG. 3). The wall member 522 is tilted toward the heat detection unit 3 with respect to a line L4 which is parallel to an orthogonal direction D2 that is perpendicular to the arrangement direction D1 (see FIG. 4). A line intersecting at right angles with this line L4 passes through the heat detection unit 3. Making the wall member 522 tilted toward the heat detection unit 3 with respect to the line L4 causes the wall member 522 to have such a shape that closes a part of the opening 7 in the arrangement direction D1 and connects the internal space SP1 to the external space SP2 through the rest of the opening 7 (see FIG. 2).

Figure 4:
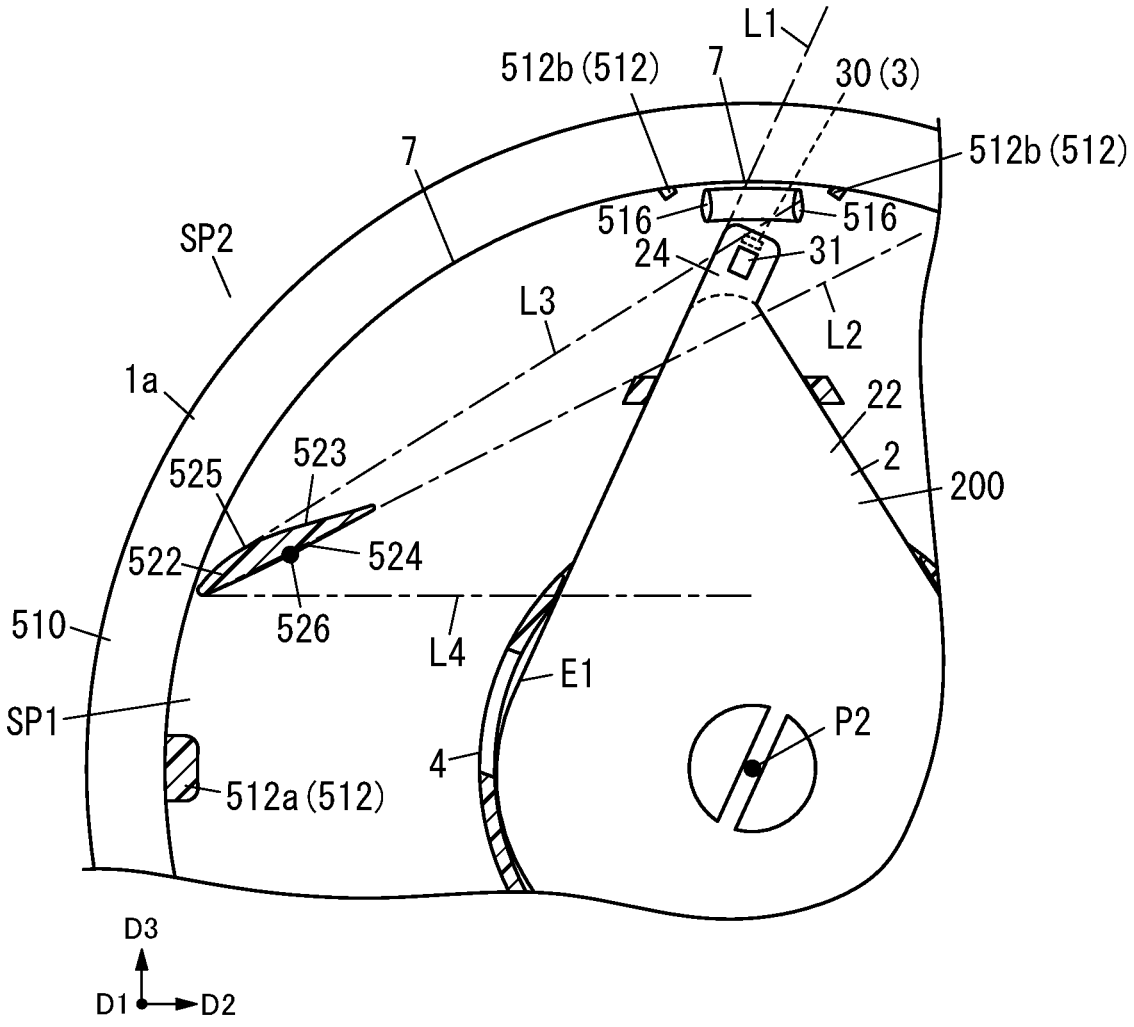
FIG. 4 is an enlarged view illustrating, on a larger scale, a part of the cross section shown in FIG. 3.

The wall member 522 has a first surface 523 facing the opening 7 and a second surface 524 facing away from the opening 7 (see FIG. 4). The second surface 524 has a different area from the first surface 523. Specifically, the area of the first surface 523 is larger than that of the second surface 524. Thus, when a cross section of the wall member 522 is viewed in the arrangement direction D1, the length of the first surface 523 is greater than that of the second surface 524. Therefore, if the flow 53 of hot air directed toward the wall member 522 is produced by a fire, for example, then the length of the hot air flowing along the first surface 523 becomes greater than that of the hot air flowing along the second surface 524. Note that in this embodiment, the first surface 523 and the second surface 524 form respective side surfaces of the wall member 522.

The first surface 523 is a raised surface which faces the opening 7 and which is convex toward the external space SP2. Specifically, the first surface 523 is a curved raised surface. On the other hand, the second surface 524 is a plane, of which an extension L2 is located closer to the board body portion 200 than to the heat detection unit 3. That is to say, when the heat sensor body 1*a* is viewed in the arrangement direction D1, the extension L2 is located closer to the smoke detection unit 4 than to the heat detection unit 3. This increases the interval between the first and second flows 64, 65 that have been separated by the wall member 522, thus reducing the chances of the first and second flows 64, 65 being confluent in the vicinity of the heat detection unit 3. Consequently, the first flow 64 of the hot air is not cooled easily. In addition, since the first surface 523 is a raised surface and the second surface 524 is a plane, the length of the hot air flowing along the first surface 523 becomes greater than that of the hot air flowing along the second surface 524.

Making the length of the hot air flowing along the first surface 523 greater than that of the hot air flowing along the second surface 524 causes the hot air to have a higher dynamic pressure and a lower static pressure on the first surface 523 than on the second surface 524. This allows the first flow 64 of the hot air to be sucked into the heat detection unit 3 and also allows the hot air in the external space SP2 to be sucked into the internal space SP1 as well.

The wall member 522 has a longitudinal axis. The longitudinal axis of the wall member 522 is parallel to the extension L2. The second surface 524 is equally divided into two at a middle 526 along the longitudinal axis. In other words, the second surface 524 is equally divided into two at the middle 526 in a direction aligned with the second surface 524. In addition, a vertex 525 of the first surface 523 is located closer to the opening 7 than the middle 526 is (see FIG. 4). In this case, the dimension between the first surface 523 and the second surface 524 becomes maximum at the vertex 525. In addition, the direction aligned with the second surface 524 agrees with the extension L2. Making the vertex 525 located closer to the opening 7 than the middle 526 increases the interval between the first and second flows 64, 65 that have been separated by the wall member 522. This reduces the chances of the first and second flows 64, 65 being confluent in the vicinity of the heat detection unit 3.

In addition, the first surface 523 and the heat detection unit 3 are in contact with a tangential line L3. Furthermore, a point of contact between the tangential line L3 and the first surface 523 is suitably located closer to the opening 7 than the vertex 525 is when the heat sensor body 1*a* is viewed in the arrangement direction D1. Furthermore, a tip portion of the wall member 522 is suitably located close to the opening 7. Note that the shape of the wall member 522 in this embodiment is called the shape of a wing with a flat bottom.

The wall member 522 includes first wall members 522*a* and second wall members 522*b* as shown in FIG. 3. Although two first wall members 522*a* and two second wall members 522*b* are provided in the example illustrated in FIG. 3, only one first wall member 522*a* and only one second wall member 522*b* may be provided. In this embodiment, the heat sensor body 1*a* includes at least two wall members. However, this is only an example and should not be construed as limiting. Alternatively, the heat sensor body 1*a* may include only one wall member 522. Each of the first wall members 522*a* and second wall members 522*b* separates the flow 63 of the gas that has entered the heat sensor body 1*a* from the external space SP2 through the opening 7 into the plurality of gas flows 64, 65.

As shown in FIG. 3, when the heat sensor body 1*a* is viewed in the arrangement direction D1, the first and second wall members 522*a*, 522*b* and the heat detection unit 3 are arranged along the peripheral edge portion 520 of the back cover 52. In addition, the heat detection unit 3 is located between the first and second wall member 522*a*, 522*b*. In other words, the first and second wall members 522*a*, 522*b* are arranged along the peripheral edge portion 520 of the back cover 52 to be located on both sides of the heat detection unit 3. Furthermore, when the heat sensor body 1*a* is viewed in the arrangement direction D1, the first and second wall members 522*a*, 522*b* are tilted toward the heat detection unit 3 with respect to the line L4 that connects together respective tips of the wall members 522 located closest to the opening 7 such that the closer to the board 2 the two wall members 522*a*, 522*b* are, the more distant from the line L4 the two wall members 522*a*, 522*b* are. In this case, the board 2 is located between the first and second wall members 522*a*, 522*b* and the line L4 intersects with an edge corresponding to one side of the geometric shape of the body portion 200 (see FIGS. 3 and 4).

Making the first and second wall members 522*a*, 522*b* tilted toward the heat detection unit 3 allows, when the flow 63 of hot air directed toward at least one wall member 522 out of the first and second wall members 522*a*, 522*b* is produced by a fire, for example, the hot air to be directed as the first flow 64 toward the heat detection unit 3. This allows the heat sensor 1 to sense the heat irrespective of the location of the fire, thus enabling the heat sensor 1 to detect the presence of the fire more accurately. In this case, as an example of this embodiment, if the heat sensor body 1*a* includes two heat detection units 3 (hereinafter referred to as a "first heat detection unit 301" and a "second heat detection unit 302," respectively), then the first and second wall members 522*a*, 522*b* are arranged along the peripheral edge portion 520 of the back cover 52 to be located on both sides of the first heat detection unit 301. In addition, the first and second wall members 522*a*, 522*b* are also located on both sides of the second heat detection unit 302 (see FIG. 3). Furthermore, in the example illustrated in FIG. 3, the closer to the board 2 the first and second wall members 522*a*, 522*b*, which are adjacent to each other with a beam 512 (first beam 512*a*) interposed between them, are, the longer the distance between the first and second wall members 522*a*, 522*b* is. In other words, the closer to the opening 7 the first and second wall members 522*a*, 522*b* are, the shorter the distance between the first and second wall members 522*a*, 522*b* is.

The opening 7 is provided through a side surface of the bottomed cylindrical shape of the heat sensor body 1*a* to communicate with the external space SP2 as shown in FIGS. 1 and 2. Specifically, the opening 7 is provided through the side surface of the front cover 51. As shown in FIGS. 1 and 2, the front cover 51 includes: a compressed circular cylindrical body 510, of which the upper and lower ends are opened; a disklike base portion 511 provided under the circular cylindrical body 510; and a plurality of (e.g., six) beams 512 that connect the circular cylindrical body 510 to the base portion 511. The circular cylindrical body 510, the base portion 511, and the plurality of beams 512 are formed integrally with each other. The plurality of beams 512 are arranged along the circumference of the peripheral edge portion of the base portion 511 (see FIG. 3). The plurality of beams 512 protrude from the peripheral edge portion toward the opened lower edge portion of the circular cylindrical body 510. These beams 512 are provided to keep a predetermined distance between the circular cylindrical body 510 and the base portion 511. The openings 7 are provided through the peripheral wall of the front cover 51 with such a configuration and arranged along the circumference of the peripheral wall.

Each of these openings 7 is a generally rectangular through hole, which radially penetrates through the peripheral wall of the front cover 51 and serves as a hole connecting the internal space SP1 to the external space SP2. In other words, the openings 7 connect the internal space SP1 in which the smoke detection unit 4 is located to the external space SP2 outside of the heat sensor body 1*a*. Note that in the example illustrated in FIG. 3, the housing 5 has six openings 7. These openings 7 are separated from each other by the plurality of beams 512.

The beams 512 include a plurality of (e.g., two) first beams 512*a* and a plurality of (e.g., four) second beams 512*b*. Also, along the circumference of the heat sensor body 1*a*, the first and second wall members 522*a*, 522*b* are provided on both sides of each first beam 512*a* (see FIG. 3). Each heat detection unit 3 faces the opening 7 interposed between two adjacent second beams 512*b*.

In addition, a pair of protecting portions 516 are provided between the opening 7 and each heat detection unit 3 (see FIG. 4). These protecting portions 516 protrude from the back cover 52 toward the base portion 511. In this case, the lower end of each of the protecting portions 516 may be out of contact with the base portion 511.

Providing the protecting portions 516 allow the protecting portions 516 to substantially prevent a person who installs the heat sensor 1, for example, from putting his or her fingers on the heat detection unit 3. That is to say, the protecting portions 516 protect the heat detection unit 3 from the installer's fingers. Protecting the heat detection unit 3 using the protecting portions 516 reduces the chances of doing damage to the heat detection unit 3.

The protecting portions 516 and the second beams 512*b* are suitably thinner than the first beams 512*a*. This allows the hot air that has flowed in the direction D3 (e.g., the forward/backward direction) from the external space SP2 to pass through the gap between the protecting portions 516 to flow more smoothly. In addition, since the length of this hot air flow in the internal space SP1 is short, the hot air is cooled less easily by the members surrounding the heat detection unit 3. This allows the heat sensor 1 to detect the presence of a fire more accurately.

The front cover 51 includes, on the upper surface of the base portion 511, a positioning structure for positioning the board 2. An exemplary positioning structure may be formed by providing a positioning recess on the upper surface of the base portion 511 and fitting a hook piece, protruding from the board 2, into the recess. The base portion 511 has a larger planar shape than the board 2 (see FIG. 6).

Figure 6:
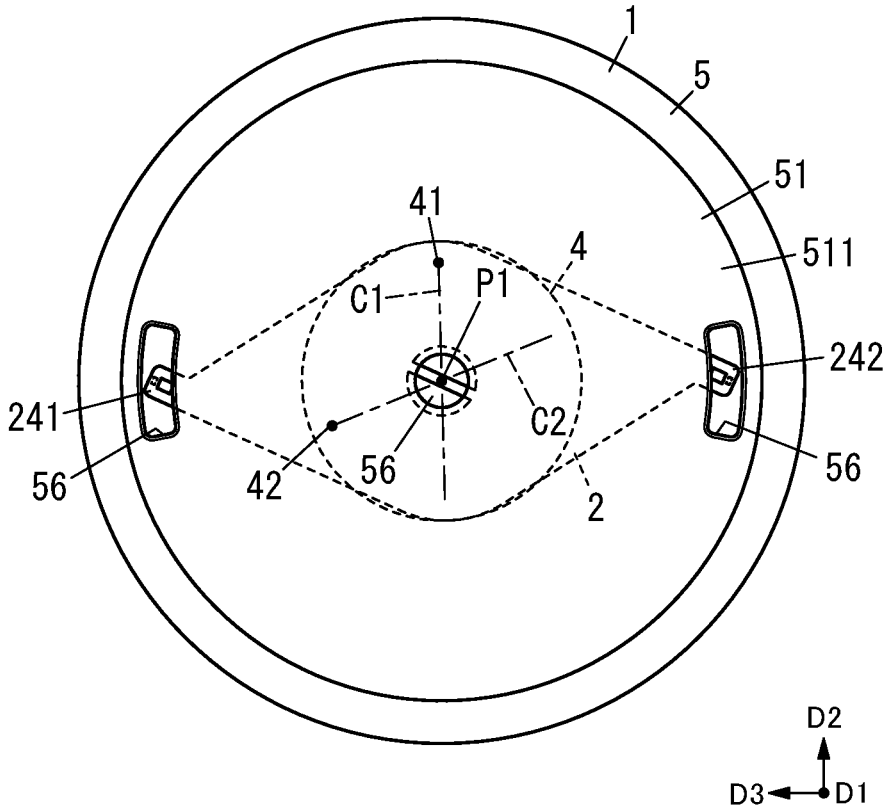
FIG. 6 is a partially see-through plan view of the heat sensor.

In addition, the front cover 51 has three vertical holes 56, which are provided through the base portion 511 thereof. Two out of the three vertical holes 56 are arranged in the direction D3 in the peripheral edge portion of the base portion 511, while the other vertical hole 56 is provided through a central area of the base portion 511. Each of these vertical holes 56 penetrates through the base portion 511 of the front cover 51 in the arrangement direction D1. The two vertical holes 56 in the peripheral edge portion of the base portion 511 each have a generally rectangular opening, while the vertical hole 56 in the central area of the base portion 511 has a generally circular opening. In addition, first and second extended portions 241, 242 (to be described later) of the board 2 respectively face the two vertical holes 56 (see FIG. 6). A central portion of the board 2 face the central vertical hole 56. As a result, the first extended portion 241, the second extended portion 242, and the central portion of the board 2 are exposed through their associated vertical hole 56 as shown in FIG. 6. Thus, the hot air rising enters the housing 5 through the vertical hole 56 and then passes through a through hole 31 to flow into the space between the first surface 21 and the second surface 52*b*. This increases the chances of the heat sensitive elements 30 being exposed to not only the hot air that has flowed in through the openings 7 but also the hot air that has flowed in through the vertical holes 56.

The back cover 52 further has a housing recess 521, which is provided on the second surface 52*b* thereof facing the board 2 to house an upper end portion of the smoke detection unit 4 mounted on the board 2 (see FIG. 1). That is to say, the housing recess 521 allows the smoke detection unit 4 to be positioned with good stability.

In addition, a plurality of (e.g., two) connection pieces 101, serving as the mounting members 10 fixed on the board 2, are fitted and inserted into the back cover 52 (see FIG. 1). The plurality of connection pieces 101 are made of an electrically conductive material such as a metal and are electrically connected to a circuit module provided on the board 2. The plurality of connection pieces 101 are inserted to the point that their respective tips protrude sufficiently from the first surface 52*a* of the back cover 52. The plurality of connection pieces 101 may be mechanically and electrically connected to connection portions of the base 1*b* fixed onto the structural component X1. That is to say, the mounting member 10 is used to not only mechanically connect the heat sensor body 1*a* to the base 1*b* but also electrically connect the heat sensor body 1*a* to electric cables (including power cables and signal cables) provided on the back of the structural component X1 and position the board 2 with good stability with respect to the back cover 52. As used herein, "positioning" includes positioning the board 2 not only in the radial direction but also in the upward/downward directions as well.

(2.4) Board

The board 2 is provided near the bottom surface of the bottomed cylindrical shape of the heat sensor body 1*a* and is housed in the heat sensor body 1*a* to face the bottom surface. Specifically, the board 2 is provided near the bottom surface of the front cover 51 (i.e., the upper surface of the base portion 511) and is housed in the heat sensor body 1*a* to face the bottom surface. The board 2 is a printed wiring board. On the board 2, mounted are, for example, the heat detection unit 3, the smoke detection unit 4, the control unit 9, the communications unit 11, and other circuit modules (not shown). Examples of the other circuit modules include a lighting circuit for turning ON an optical element 41 of the smoke detection unit 4 and a power supply circuit for generating operating power for various types of circuits based on the power supplied from a commercial power supply, for example. The board 2 has a geometric shape when viewed in the arrangement direction D1. As used herein, the "geometric shape" refers to the shape of a polygon having three or more sides, a circle, or an ellipse. The board 2 may be formed in, for example, a generally diamond shape (see FIG. 3).

In this embodiment, the two heat detection units 3 are surface-mounted on the first surface 21 of the board 2 (see FIG. 1). The first surface 21 is the upper surface. In this embodiment, the smoke detection unit 4 is also mounted on the first surface 21. The smoke detection unit 4 includes, on a bottom portion thereof, a plurality of hooks. These hooks position the board 2 by clamping the board 2 between themselves.

The control unit 9 and a plurality of electronic components that form the circuit modules are mounted on either the first surface 21 or second surface 22 of the board 2. The control unit 9 and the plurality of electronic components that form the circuit modules do not have to be mounted on only the board 2. Optionally, an additional mount board may be arranged around the board 2 and some or all of the control unit 9 and those electronic components may be mounted on the additional mount board.

The board 2 also has a second surface 22, which is substantially parallel to the first surface 21 and which faces the base portion 511 (see FIG. 1). The second surface 22 is a lower surface. In FIG. 6, the board 2 is illustrated as a see-through one and the second surface 22 thereof is seen. In particular, in FIG. 6, the optical element 41 and a photosensitive element 42, which are arranged inside the smoke detection unit 4, are illustrated in the simplified form of dots.

Next, the structure of the board 2 will be described in detail. As shown in FIG. 3, the board 2 includes a board body portion (body portion) 200 and a plurality of (e.g., two) extended portions 24. The body portion 200 forms the body of the board 2 and has a geometric shape. The body portion 200 may have, for example, a generally diamond shape (see FIG. 3). Each of the extended portions 24 extends from an end portion of the body portion 200 toward the external space SP2. This allows the heat detection unit 3 to detect not only the hot air of the first flow 64 but also the heat of the hot air flowing toward the extended portion 24. In FIG. 3, the end portion of the body portion 200 is indicated by the dashed double circles (in phantom). In such extended portions 24, the heat detection units 3 are provided and each of the heat detection units 3 includes the heat sensitive element 30. The heat sensitive element 30 is a chip thermistor.

If the heat detection unit 3 includes a chip thermistor, then the volume required for the heat detection unit 3 in the internal space SP1 may be reduced, thus contributing to reducing the overall size (in particular, the thickness) of the heat sensor 1.

When the heat sensor body 1*a* is viewed in the arrangement direction D1, each of the extended portions 24 is extended along an edge of the body portion 200 from an associated end portion of the body portion 200 toward the external space SP2. Specifically, each extended portion 24 is extended along an edge, corresponding to one side of the geometric shape, of the body portion 200 from an associated end portion of the body portion 200 toward the external space SP2. The heat detection unit 3 is mounted at the tip of such an extended portion 24. This allows the heat detection unit 3 mounted on the extended portion 24 to detect the heat generated by a fire. In addition, since the two wall members 522 are provided on both sides of the heat detection unit 3, a flow of the hot air directed toward the heat detection unit 3 may be produced, irrespective of the angle at which the hot air enters the internal space SP1 from the external space SP2.

The plurality of extended portions 24 includes the first extended portion 241 and the second extended portion 242. The first extended portion 241 is extended from an end portion of the body portion 200 toward the external space SP2. The second extended portion 242 is arranged symmetrically to the first extended portion 241 with respect to an intersection P2 between a center axis C3 passing through the center of the heat sensor body 1*a* and the body portion 200. The first heat detection unit 301 is provided on the first extended portion 241 and the second heat detection unit 302 is provided on the second extended portion 242. In this case, the center axis C3 is parallel to the arrangement direction D1 and passes through the center P1 of the smoke detection unit 4 and the center of the heat sensor body 1*a*. The center P1 of the smoke detection unit 4 is located at a position that equally divides the distance between the lower surface of the back cover 52 and the upper surface of the base portion 511 into two. Thus, the center of the heat sensor body 1*a* is located at the same point as the center P1, and therefore, the center P1 looks overlapping with the intersection P2 when the board 2 is viewed in the arrangement direction D1.

Arranging the first extended portion 241 and the second extended portion 242 symmetrically to each other with respect to the intersection P2 allows either or both of the first and second heat detection units 301, 302 to detect the hot air when a fire is present. In addition, providing the first wall member 522*a* and the second wall member 522*b* as well enables producing a flow of the hot air directed toward the heat detection unit 3, irrespective of the angle at which the hot air enters the internal space SP1 from the external space SP2. Furthermore, even if the height of the opening 7 is decreased by reducing the thickness of the heat sensor 1, the first wall member 522*a* and the second wall member 522*b* may easily perform the function of sucking the hot air from the external space SP2 into the internal space SP1. Furthermore, the first wall member 522*a* and the second wall member 522*b* allow turning the hot air that has entered the internal space SP1 into a flow directed toward the heat detection unit 3.

On top of that, each of the first and second extended portions 241, 242 is provided with a through hole 31 (see FIGS. 3 and 4) with a rectangular opening. FIG. 4 is an enlarged view illustrating, on a larger scale, a part of the board 2 shown in FIG. 3. Each through hole 31 is provided inside of its associated heat detection unit 3. In other words, the through hole 31 is arranged between the heat detection unit 3 and the body portion 200. In addition, the heat detection unit 3 and the through hole 31 are arranged adjacent to each other. Providing such a through hole 31 beside each heat detection unit 3 may reduce the area of the board 2 around the heat detection unit 3, thus reducing the chances of the transfer of the heat of the heat detection unit 3 through the board 2 lowering the temperature of the heat detection unit 3. That is to say, the through hole 31 improves the thermal insulation properties. The opening area of the through hole 31 is suitably larger than the surface area of the heat sensitive element 30 (e.g., its surface area as viewed from over the board 2).

(2.5) Heat Detection Unit and Smoke Detection Unit

As described above, the heat detection units 3 include the two heat sensitive elements 30 which are mounted on the first surface 21 of the board 2 (see FIG. 3). The number of the heat sensitive elements 30 provided is not limited to any particular number but may also be one. Nevertheless, at least two heat sensitive elements 30 are suitably provided. In addition, each heat sensitive element 30 according to this embodiment is a chip thermistor for detecting the heat of the hot air that has flowed in from the external space SP2 through the opening 7 and is surface-mounted on an associated extended portion 24 of the board 2. The respective heat sensitive elements 30 are arranged such that each of the heat sensitive elements 30 faces an associated one of the different openings 7. This allows each heat sensitive element 30 to detect the heat of the hot air that has flowed in from the external space SP2 through the opening 7. Note that the relative positions of the heat sensitive elements 30 with respect to the openings 7 will be described in detail later in the "(2.7) Arrangement structure of heat detection unit" section.

The heat detection units 3 are electrically connected, via patterned wiring formed on the board 2 and other members, to the control unit 9. Each heat sensitive element 30 outputs an electrical signal (detection signal) to the control unit 9. In other words, the control unit 9 monitors, based on the electrical signals provided by the respective heat sensitive elements 30, the resistance values, which may vary as the temperature increases, of the respective heat sensitive elements 30.

Optionally, the heat detection units 3 may include not only the heat sensitive elements 30 but also an amplifier circuit for amplifying the electrical signals provided by the heat sensitive elements 30, a converter circuit for performing analog-to-digital conversion on the electrical signals, and other circuits as well. Alternatively, the amplification and conversion may be performed by the circuit modules.

Figure 5:
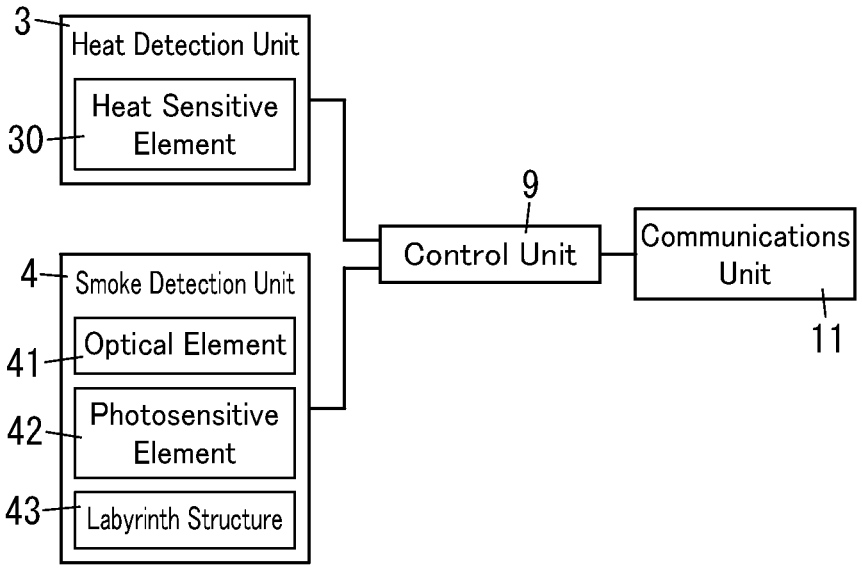
FIG. 5 illustrates a schematic block configuration of the heat sensor.
Figure 7:
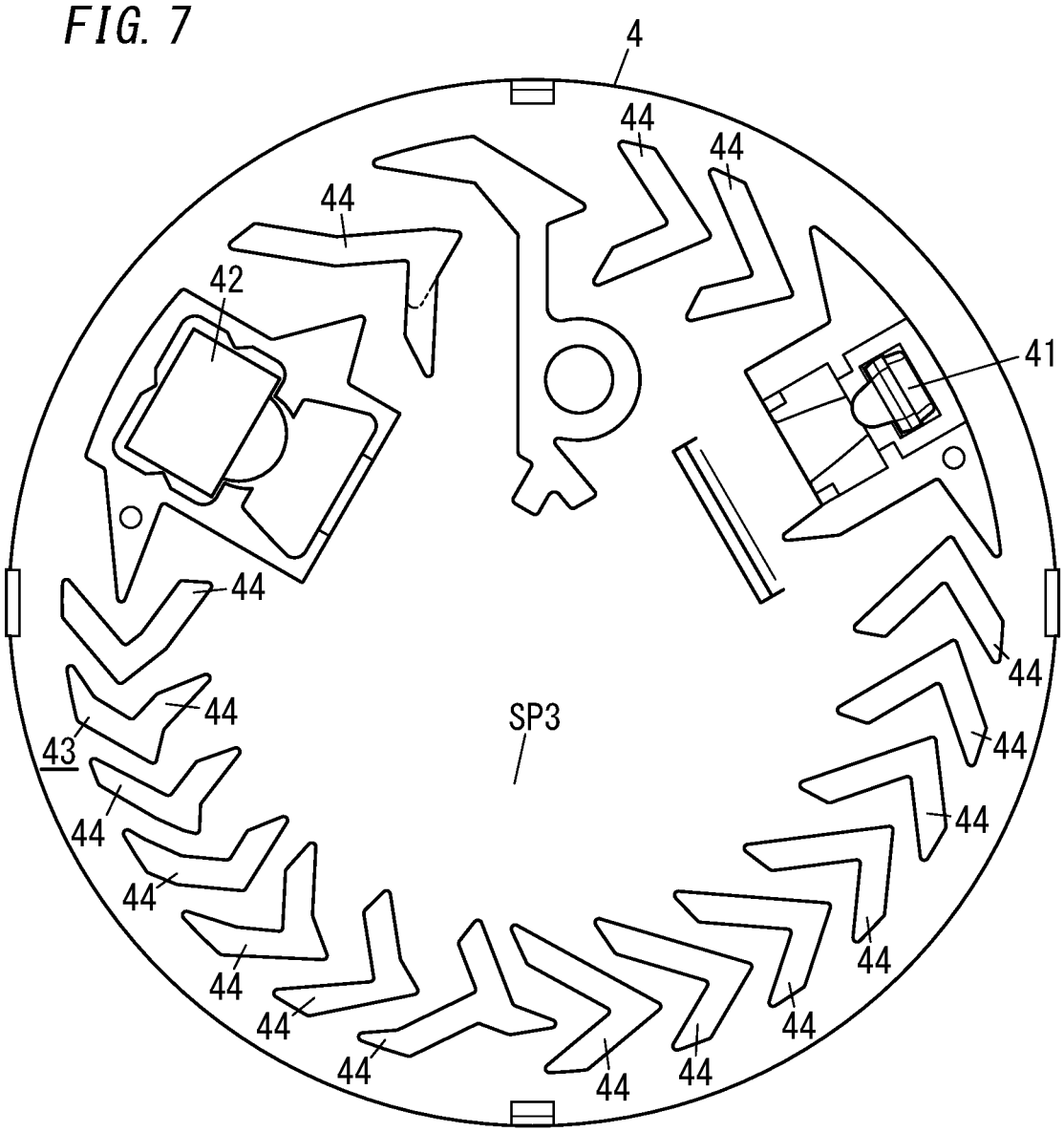
FIG. 7 is a plan view showing the inside of a smoke detection unit included in a smoke and heat detector according to an exemplary embodiment.

The smoke detection unit 4 is arranged in a central area of the internal space SP1. Specifically, the smoke detection unit 4 is arranged on the first surface 21 of the body portion 200 and has an upper end portion thereof housed in the housing recess 521 of the back cover 52. The smoke detection unit 4 may be a photoelectric sensor for detecting smoke, for example. As shown in FIGS. 5 and 7, the smoke detection unit 4 includes an optical element 41 for emitting light, a photosensitive element 42 for receiving the light emitted from the optical element 41, and a labyrinth structure 43. The optical element 41 may be a light-emitting diode (LED), for example. The photosensitive element 42 may be a photodiode, for example. The labyrinth structure 43 is formed inside a case having a compressed, generally circular cylindrical shell. The labyrinth structure 43 is a collection of a plurality of small pieces 44 which are arranged along an inner side surface of the case of the smoke detection unit 4 (see FIG. 7). The labyrinth structure 43 allows smoke to pass through a plurality of these small pieces 44. The case of the smoke detection unit 4 has a structure having, on an outer peripheral surface thereof, a plurality of ports to introduce a gas into the labyrinth structure 43 and reducing incidence of external light onto the internal space thereof. Note that the internal shape of the smoke detection unit 4, the locations of the optical element 41 and the photosensitive element 42, for example, the shape and location of the labyrinth structure 43, and other parameters may be designed appropriately according to the properties of smoke flowing in the heat sensor 1.

The optical element 41 and the photosensitive element 42 are arranged in the smoke detection unit 4 to avoid facing each other. In other words, the optical element 41 and the photosensitive element 42 are arranged such that the photosensitive plane of the photosensitive element 42 is off the optical axis C1 (see FIG. 6) of the light emitted from the optical element 41.

At the outbreak of a fire, for example, smoke may enter the housing 5 through the openings 7 of the housing 5 and be introduced into the smoke detection unit 4. If no smoke is present in the smoke detection unit 4, the light emitted from the optical element 41 hardly reaches the photosensitive plane of the photosensitive element 42. On the other hand, if there is any smoke in the smoke detection unit 4, then the light emitted from the optical element 41 is scattered by the smoke and part of the scattered light eventually impinges on the photosensitive plane of the photosensitive element 42. That is to say, the smoke detection unit 4 is configured to have the light, which has been emitted from the optical element 41 and scattered by the smoke, received at the photosensitive element 42.

The photosensitive element 42 is electrically connected to the control unit 9. The smoke detection unit 4 transmits an electrical signal (detection signal), having a voltage level representing the quantity of light received at the photosensitive element 42, to the control unit 9. In response, the control unit 9 converts the quantity of the light, represented by the detection signal provided by the smoke detection unit 4, into a smoke concentration, thereby determining whether or not a fire is actually present. Optionally, the control unit 9 may use the quantity of the light as it is to make a decision based on a threshold value. Alternatively, the smoke detection unit 4 may convert the quantity of light received at the photosensitive element 42 into a smoke concentration and then transmit a detection signal, having a voltage level representing the smoke concentration, to the control unit 9.

The smoke detection unit 4 may further include an amplifier circuit for amplifying the electrical signal provided by the photosensitive element 42, a converter circuit for performing an analog-to-digital conversion on the electrical signal, and other circuits. Alternatively, the amplification and conversion may be performed by the circuit modules. Also, the number of the optical element 41 for use to detect smoke does not have to be one but may also be plural.

(2.6) Control Unit

The control unit 9 is implemented as a microcontroller including, as major constituent elements, a central processing unit (CPU) and a memory. That is to say, the control unit 9 is implemented as a computer including the CPU and the memory. The computer performs the function of the control unit 9 by making the CPU execute a program stored in the memory. In this embodiment, the program is stored in advance in the memory. However, this is only an example and should not be construed as limiting. The program may also be downloaded via a telecommunications line such as the Internet or distributed after having been stored in a non-transitory storage medium such as a memory card.

The control unit 9 is configured to control the communications unit 11 and circuit modules (including the lighting circuit and the power supply circuit).

In addition, the control unit 9 is also configured to receive detection signals from the heat detection unit 3 and the smoke detection unit 4 to determine whether or not a fire is actually present. Specifically, the control unit 9 monitors the respective detection signals provided by the respective heat detection units 3 on an individual basis, and decides, on finding at least one heat sensitive element 30, of which the signal level (corresponding to a resistance value) included in the detection signal is greater than (or less than) the threshold value, that a fire should be present. In addition, the control unit 9 also monitors the detection signal provided by the smoke detection unit 4 and decides, on finding the signal level (corresponding to the quantity of light received at the photosensitive element 42 or a smoke concentration) included in the detection signal greater than a threshold value, that a fire should be present.

On deciding, based on either the signal level of the heat detection or the signal level of the smoke detection, that a fire should be present, the control unit 9 makes the communications unit 11 transmit a signal alerting a person to the presence of the fire to a receiver, fire alarm devices, and other devices of an automatic fire alarm system. The communications unit 11 may be implemented as a communications interface for communicating, via cables, for example, with the receiver, the fire alarm devices, and other devices. The communications unit 11 is connected to communicate with the receiver, the fire alarm devices, and other devices via the connection pieces 101 of the mounting member 10, the connector portion of the base 1*b*, and the signal cables provided on the back of the structural component X1.

(2.7) Arrangement Structure of Heat Detection Unit

Next, the arrangement structure of the heat detection unit 3 according to this embodiment will be described.

In this embodiment, each heat sensitive element 30 is a chip thermistor mounted on the first surface 21 of the board 2 as described above, thus contributing to reducing the overall size (the thickness, among other things) of the heat sensor 1. In addition, this also cuts down the cost of the thermistor itself and the mounting cost thereof, compared to lead-type thermistors.

Furthermore, according to this embodiment, when the flow 63 of the hot air directed toward the wall member 522 is produced in the external space SP2, this flow 63 is separated by the wall member 522, thus producing, in the internal space SP1, the first flow 64 of the hot air directed toward the heat detection unit 3. Thus, at least part of the first surface 21 of each extended portion 24 is exposed to the first flow 64.

Exposing the first surface 21 of the extended portions 24 to the first flow 64 in this manner further increases the chances of the four heat sensitive elements 30, provided for the extended portions 24, being exposed to the hot air of the first flow 64, even though the heat sensitive elements 30 are chip thermistors.

Specifically, while the hot air generated by the outbreak of a fire, for example, is rising from under the heat sensor 1, the hot air is introduced through the plurality of openings 7 into the housing 5 to flow toward the heat detection units 3. In the meantime, the heat sensitive elements 30 detect the heat, of which the temperature is high enough to indicate the presence of a fire, thus allowing the heat sensor 1 to quickly decide that a fire should be present. This contributes to downsizing the heat sensor 1 while further improving the heat detection performance of the heat sensor 1.

In this case, the heat sensor 1 according to this embodiment further includes the smoke detection unit 4 provided in the central area of the internal space SP1. Thus, if the gas introduced into the housing 5 through the plurality of openings 7 has a smoke concentration equal to or greater than a predetermined concentration, the heat sensor 1 is also able to detect smoke. This contributes to reducing the overall size of the heat sensor 1 while further improving the fire sensing performance thereof.

When the opening 7 is viewed from the external space SP2, each heat sensitive element 30 is located around the middle of the height of the opening 7. This positional relationship may be adjusted by changing the protrusion height of the ribs 514 (see FIG. 1) protruding from the back surface of the base portion 511 of the front cover 51 to contact with the board 2, for example. Adopting such a positional relationship increases, compared to a situation where the heat sensitive element 30 is located close to one end of the opening 7 (i.e., close to either the upper end or the lower end), for example, the chances of the heat sensitive element 30 being exposed to the gas flowing in through the opening 7.

The center P1 of the internal space of the smoke detection unit 4 and the center of the heat sensor body 1*a* are suitably located on a line parallel to the arrangement direction D1 (i.e., on the center axis C3) (see FIGS. 1 and 6). In FIG. 6, the optical element 41 and photosensitive element 42 arranged in the smoke detection unit 4 are schematically indicated by dots. In this embodiment, the optical element 41 and the photosensitive element 42 may have the same height and the intersection between the optical axis C1 of the optical element 41 and the optical axis C2 of the photosensitive element 42 may substantially agree with the center P1, for example.

The height levels of the optical element 41 and the photosensitive element 42 and the directions of their optical axes C1 and C2 are not limited to any particular ones, as long as the optical axis C1 does not intersect with the photosensitive plane of the photosensitive element 42. For example, the height of one of the optical element 41 or the photosensitive element 42 may be lower than that of the other. In addition, the optical axes C1 and C2 do not have to intersect with each other. In that case, as viewed from beside the smoke detection unit 4, a midpoint between the optical axes C1 and C2 may substantially agree with the center P1.

(3) Variations

Note that the embodiment described above is only an exemplary one of various embodiments of the present disclosure and should not be construed as limiting. Rather, the exemplary embodiment may be readily modified in various manners depending on a design choice or any other factor without departing from the scope of the present disclosure. The functions of the heat sensor 1 according to the exemplary embodiment described above may also be implemented as, for example, a method for controlling the heat sensor 1, a computer program, or a non-transitory storage medium that stores the computer program.

Next, variations of the exemplary embodiment will be enumerated one after another. The variations to be described below may be adopted in combination as appropriate. In the following description, the exemplary embodiment described above will be hereinafter sometimes referred to as a "basic example."

The control unit 9 of the heat sensor 1 according to the present disclosure includes a computer system. In that case, the computer system may include, as principal hardware components, a processor and a memory. The functions of the control unit 9 of the heat sensor 1 according to the present disclosure may be performed by making the processor execute a program stored in the memory of the computer system. The program may be stored in advance in the memory of the computer system. Alternatively, the program may also be downloaded through a telecommunications line or be distributed after having been recorded in some non-transitory storage medium such as a memory card, an optical disc, or a hard disk drive, any of which is readable for the computer system. The processor of the computer system may be implemented as a single or a plurality of electronic circuits including a semiconductor integrated circuit (IC) or a large-scale integrated circuit (LSI). As used herein, the "integrated circuit" such as an IC or an LSI is called by a different name depending on the degree of integration thereof. Examples of the integrated circuits include a system LSI, a very large-scale integrated circuit (VLSI), and an ultra-large scale integrated circuit (ULSI). Optionally, a field-programmable gate array (FPGA) to be programmed after an LSI has been fabricated or a reconfigurable logic device allowing the connections or circuit sections inside of an LSI to be reconfigured may also be adopted as the processor. Those electronic circuits may be either integrated together on a single chip or distributed on multiple chips, whichever is appropriate. Those multiple chips may be integrated together in a single device or distributed in multiple devices without limitation. As used herein, the "computer system" includes a microcontroller including one or more processors and one or more memories. Thus, the microcontroller may also be implemented as a single or a plurality of electronic circuits including a semiconductor integrated circuit or a large-scale integrated circuit.

Also, in the embodiment described above, the plurality of constituent elements (or the functions) of the control unit 9 of the heat sensor 1 are integrated together in a single housing. However, this is not an essential configuration for the heat sensor 1. Alternatively, those constituent elements (or functions) of the heat sensor 1 may be distributed in multiple different housings. Still alternatively, at least some functions of the heat sensor 1 (e.g., some functions of the heat sensor 1) may be implemented as a cloud computing system as well. Conversely, the plurality of functions of the heat sensor 1 may be integrated together in a single housing as in the basic example described above.

(3.1) Other Variations

The heat sensor 1 according to the basic example described above (i.e., smoke and heat detector) includes two heat detection units 3. In one variation, however, only one heat detection unit 3 may be provided. Alternatively, three or more heat detection units 3 may be provided. In particular, six or more heat detection units 3 may be provided. In any of these variations, the first wall member 522*a* and the second wall member 522*b* may also be provided on both sides of each heat detection unit 3.

In the basic example described above, the first wall member 522*a* and the second wall member 522*b* are provided on both sides of each heat detection unit 3. Alternatively, either the first wall member 522*a* or the second wall member 522*b* may be provided.

In the basic example described above, the first surface 523 is a curved surface. Alternatively, the first surface 523 may also be a plane which is bent halfway.

In the basic example described above, the wall member 522 forms part of the housing 5. Alternatively, the wall member 522 may also be provided for a different member. In that case, the different member including the wall member 522 may be housed inside the housing 5.

In the basic example described above, the board 2 has a diamond shape. Alternatively, the board 2 may also have a triangular, circular, or any other arbitrary shape. The shape may be determined depending on, for example, the number of the extended portions 24 provided.

In the basic example described above, no display unit indicating an activated state of the heat sensor 1 is provided. Optionally, such a display unit may be provided for the base portion 511, for example.

The heat sensor 1 according to the basic example includes no batteries. However, a battery may be provided between the back cover 52 and the base 1*b*. In that case, the battery is electrically connected to the board 2. Thus, even if a fire is present around the heat sensor 1 when a blackout is caused, the heat sensor 1 may also be activated with the power supplied from the battery.

The heat sensor 1 according to the basic example described above includes the mounting member 10. Alternatively, the heat sensor 1 may include a battery instead of the mounting member 10.

Even though the heat sensitive element 30 according to the basic example is a chip thermistor, the heat sensitive element 30 may also be a lead-type thermistor. In that case, the front cover 51 may be changed into a shape that covers the lead-type thermistor.

In the basic example, the heat sensitive elements 30 are mounted on the first surface 21 of the board 2. However, this is only an example of the present disclosure and should not be construed as limiting. Alternatively, the heat sensitive elements 30 may also be mounted on the second surface 22 of the board 2. Still alternatively, some of the plurality of heat sensitive elements 30 may be mounted on the first surface 21, while the other heat sensitive elements 30 may be mounted on the second surface 22. Optionally, both the heat sensitive elements 30 and the smoke detection unit 4 may be mounted on the second surface 22 of the board 2.

The number of the through hole(s) 31 adjacent to each heat sensitive element 30 is supposed to be one in the basic example but may also be two or more. For example, a plurality of through holes 31 may be provided to surround each heat sensitive element 30.

In the basic example, the board 2 is implemented as a single printed wiring board. However, this is only an example of the present disclosure and should not be construed as limiting. Alternatively, the board 2 may also be implemented separately as two or more printed wiring boards. Nevertheless, in that case, the two or more printed wiring boards are suitably arranged on the same plane.

(4) Recapitulation

As can be seen from the foregoing description, a heat sensor (1) according to a first aspect includes a base (1*b*) and a heat sensor body (1*a*). The base (1*b*) is to be mounted onto a mounting surface (X11) of a building. The heat sensor body (1*a*) has a bottomed cylindrical shape and is to be attached to the base (1*b*). The heat sensor body (1*a*) includes an opening (7), a board (2), a heat detection unit (3), and at least one wall member (522). The opening (7) is provided through a side surface of the bottomed cylindrical shape of the heat sensor body (1*a*) and communicates with an external space (SP2). The board (2) is housed in the vicinity of a bottom surface of the bottomed cylindrical shape of the heat sensor body (1*a*) to face the bottom surface. The heat detection unit (3) is mounted on an end portion of the board (2) to detect heat of a gas flowing in from the external space (SP2). The at least one wall member (522) controls flow of the gas to cause the gas that passed through the opening (7) to flow toward the heat detection unit (3). The at least one wall member (522) separates the flow of the gas that has entered the heat sensor body (1*a*) from the external space (SP2) through the opening (7) into a plurality of gas flows and directs one of the plurality of gas flows, which has been separated to flow beside an inner surface of the heat sensor body (1*a*), toward the heat detection unit (3).

According to the first aspect, the gas flow (63) directed toward the wall member (522) is controlled by the wall member (522) to turn into a gas flow (64) directed toward the heat detection unit (3). In addition, the length of the gas flow (64) directed toward the heat detection unit (3) may be shortened between the wall member (522) and the heat detection unit (3). This may reduce the chances of lowering the heat of the gas directed from the wall member (522) toward the heat detection unit (3), thus shortening the time it takes for the heat sensor (1) to detect the presence of a fire.

A second aspect is an implementation of the heat sensor (1) according to the first aspect. In the second aspect, the board (2) includes a board body portion (200) and an extended portion (24). The board body portion (200) forms a body of the board (2). The extended portion (24) is extended from an end portion of the board body portion (200) toward the external space (SP2) to mount the heat detection unit (3) on a tip thereof.

The second aspect allows the heat detection unit (3) to detect not only the heat of the gas flow (64) but also the heat of the gas directed toward the extended portion (24).

A third aspect is an implementation of the heat sensor (1) according to the second aspect. In the third aspect, the heat detection unit (3) includes a chip thermistor (heat sensitive element 30) mounted on the extended portion (24).

The third aspect may reduce the volume required for the heat detection unit (3) in the internal space (SP1), thus contributing to reducing the overall size of the heat sensor (1).

A fourth aspect is an implementation of the heat sensor (1) according to the second or third aspect. In the fourth aspect, the extended portion (24) is extended along an edge of the heat sensor body (1*a*) from the end portion toward the external space (SP2) when the heat sensor body (1*a*) is viewed in an arrangement direction (D1).

The fourth aspect allows the heat detection unit (3) to detect not only the heat of the gas flow (64) but also the heat of the gas directed toward the extended portion (24).

A fifth aspect is an implementation of the heat sensor (1) according to any one of the second to fourth aspects. In the fifth aspect, the extended portion (24) includes a first extended portion (241) and a second extended portion (242). The first extended portion (241) is extended from the end portion of the board body portion (200) toward the external space (SP2). The second extended portion (242) is arranged symmetrically to the first extended portion (241) with respect to an intersection (P2) between the board body portion (200) and a center axis (C3) passing through a center of the heat sensor body (1*a*). The heat detection unit (3) includes a first heat detection unit (301) and a second heat detection unit (302). The first heat detection unit (301) is provided in the first extended portion (241). The second heat detection unit (302) is provided in the second extended portion (242). Each of the first heat detection unit (301) and the second heat detection unit (302) includes a chip thermistor (heat sensitive element 30).

The fifth aspect may reduce the volume required for the first and second heat detection units (301, 302) in the internal space (SP1), thus contributing to reducing the overall size of the heat sensor (1).

A sixth aspect is an implementation of the heat sensor (1) according to any one of the first to fifth aspects. In the sixth aspect, the heat sensor body (1*a*) further includes a cap member (52) arranged between the base (1*b*) and the board (2). The heat sensor body (1*a*) includes at least two wall members (522), at least one of which is the at least one wall member (522). When the heat sensor body (1*a*) is viewed in an arrangement direction (D1), two wall members (522), out of the at least two wall members (522), and the heat detection unit (3) are arranged along a peripheral edge portion (520) of the cap member (52). The heat detection unit (3) is located between the two wall members (522), and the board (2) is located between the two wall members (522). When the heat sensor body (1*a*) is viewed in the arrangement direction (D1), the two wall members (522) are tilted toward the heat detection unit (3) with respect to a line (L4) that connects together respective tips of the two wall members (522) located closest to the opening (7) such that the closer to the board (2) the two wall members (522) are, the more distant from the line (L4) the two wall members (522) are.

According to the sixth aspect, the gas flow (63) directed toward the wall member (522) is controlled by the wall member (522) to turn into a gas flow (64) directed toward the heat detection unit (3). In addition, the length of the gas flow (64) directed toward the heat detection unit (3) may be shortened between the wall member (522) and the heat detection unit (3). This may reduce the chances of lowering the heat of the gas directed from the wall member (522) toward the heat detection unit (3), thus shortening the time it takes for the heat sensor (1) to detect the presence of a fire.

A seventh aspect is an implementation of the heat sensor (1) according to any one of the first to sixth aspects. In the seventh aspect, the at least one wall member (522) has such a shape that closes a part of the opening (7) in an arrangement direction (D1) and that connects an internal space (SP1) to the external space (SP2) through the rest of the opening (7).

According to the seventh aspect, the gas flow (63) directed toward the wall member (522) is controlled by the wall member (522) to turn into a gas flow (64) directed toward the heat detection unit (3). In addition, the length of the gas flow (64) directed toward the heat detection unit (3) may be shortened between the wall member (522) and the heat detection unit (3). This may reduce the chances of lowering the heat of the gas directed from the wall member (522) toward the heat detection unit (3), thus shortening the time it takes for the heat sensor (1) to detect the presence of a fire.

An eighth aspect is an implementation of the heat sensor (1) according to any one of the first to seventh aspects. In the eighth aspect, the at least one wall member (522) includes a first surface (523) facing the opening (7) and a second surface (524) facing away from the opening (7). The second surface (524) has a different area from the first surface (523). When a cross section of the wall member (522) is viewed in an arrangement direction (D1), the first surface (523) has a greater length than the second surface (524).

According to the eighth aspect, the hot air has a higher dynamic pressure and a lower static pressure on the first surface (523) than on the second surface (524). This allows the gas flow (64) to be sucked into the heat detection unit (3) and also allows the gas in the external space (SP2) to be sucked into the internal space (SP1).

A ninth aspect is an implementation of the heat sensor (1) according to the eighth aspect. In the ninth aspect, the first surface (523) is a raised surface which is convex toward the external space (SP2), and the second surface (524) is a plane.

According to the ninth aspect, the hot air has a higher dynamic pressure and a lower static pressure on the first surface (523) than on the second surface (524). This allows the gas flow (64) to be sucked into the heat detection unit (3) and also allows the gas in the external space (SP2) to be sucked into the internal space (SP1).

A tenth aspect is an implementation of the heat sensor (1) according to the ninth aspect. In the tenth aspect, when the cross section of the at least one wall member (522) is viewed in the arrangement direction (D1), a vertex (525) of the first surface (523) is located closer to the opening (7) than a middle (526), at which the second surface (524) is equally divided into two in a direction aligned with the second surface (524), is. At the vertex (525), a dimension between the first surface (523) and the second surface (524) becomes maximum.

According to the tenth aspect, the length of the gas flow (64) directed toward the heat detection unit (3) may be shortened between the wall member (522) and the heat detection unit (3). This may reduce the chances of lowering the heat of the gas directed from the wall member (522) toward the heat detection unit (3), thus shortening the time it takes for the heat sensor (1) to detect the presence of a fire.

An eleventh aspect is an implementation of the heat sensor (1) according to the ninth or tenth aspect. In the eleventh aspect, the board (2) includes a board body portion (200) and an extended portion (24). The board body portion (200) forms a body of the board (2). The extended portion (24) is extended from an end portion of the board body portion (200) toward the external space (SP2). The heat detection unit (3) is provided in the extended portion (24). An extension (L2) of the second surface (524) is located closer to the board body portion (200) than to the heat detection unit (3).

The eleventh aspect reduces the chances of the gas flows that have been separated by the wall member (522) from the flow (64) being confluent in the vicinity of the heat detection unit (3). This may reduce the chances of lowering the heat of the gas flow (64).

A twelfth aspect is a smoke and heat fire detector which includes a smoke detection unit (4) to determine whether or not a fire is present by sensing, in a space inside a stray light attenuating labyrinth structure, a smoke component that has entered the heat sensor body (1*a*) as a component of the gas. The smoke detection unit (4) is provided close to a center of the board (2) of the heat sensor (3) so as to avoid interfering with the heat detection unit (3) and the at least one wall member (522). The smoke and heat fire detector determines, based on at least one of a result of detection obtained by the smoke detection unit (4) or a result of detection obtained by the heat detection unit (3), whether or not a fire is present.

According to the twelfth aspect, a determination may be made, by using at least one of the smoke detection unit (4) or the heat detection unit (3), whether or not a fire is present, thus facilitating making a decision about the presence of a fire.

Note that in the basic example and variations described above, instances that use the heat detection unit (3), the smoke detection unit (4), and the gas detection unit have been described. However, the detection unit of the heat sensor (1) does not have to be only the heat detection unit (3). If the heat sensor (1) is implemented as a smoke and heat fire detector, the smoke and heat fire detector may be provided with a smoke detection unit (4) close to the center so as to avoid interfering with the heat detection unit (3) and the wall member (522) to determine whether or not a fire is present by sensing, in a space (SP3) inside a stray light attenuating labyrinth structure, a smoke component that has entered the heat sensor body (1*a*) as a component of the gas from the external space (SP2). The smoke and heat fire detector may be designed to determine, based on at least one of a result of detection obtained by the smoke detection unit (4) or a result of detection obtained by the heat detection unit (3), whether or not a fire is present. As an exemplary fire detection operation of such a smoke and heat fire detector, a fire determination algorithm disclosed in JP 4066761 B2, for example, may be adopted.

REFERENCE SIGNS LIST

1 Heat Sensor
1*a* Heat Sensor Body
1*b* Base
2 Board
200 Board Body Portion
21 One Surface
24 Extended Portion
241 First Extended Portion
242 Second Extended Portion
3 Heat Detection Unit
301 First Heat Detection Unit
302 Second Heat Detection Unit
30 Heat Sensitive Element
63 Flow
64 Flow
7 Opening
52 Cap Member
522 Wall Member
523 First Surface
524 Second Surface
525 Vertex
D1 Arrangement Direction
L2 Extension
P2 Intersection
SP1 Internal Space
SP2 External Space
X11 Mounting Surface

The invention claimed is:

1. A heat sensor comprising:
a base configured to be mounted onto a mounting surface of a building; and
a heat sensor body having a bottomed cylindrical shape and configured to be attached to the base,
the heat sensor body including:
an opening provided through a side surface of the bottomed cylindrical shape of the heat sensor body and communicating with an external space;
a board housed in the vicinity of a bottom surface of the bottomed cylindrical shape of the heat sensor body to face the bottom surface;
a heat detection unit mounted on an end portion of the board to detect heat of a gas flowing in from the external space; and
at least one wall member configured to control flow of the gas to cause the gas that passed through the opening to flow toward the heat detection unit,
the at least one wall member being configured to separate the flow of the gas that has entered the heat sensor body from the external space through the opening into a plurality of gas flows and direct one of the plurality of gas flows, which has been separated to flow beside an inner surface of the heat sensor body, toward the heat detection unit.

2. The heat sensor of claim 1, wherein
the board includes:
a board body portion forming a body of the board; and
an extended portion extended from an end portion of the board body portion toward the external space to mount the heat detection unit on a tip thereof.

3. The heat sensor of claim 2, wherein
the heat detection unit includes a chip thermistor mounted on the extended portion.

4. The heat sensor of claim 2, wherein
the extended portion is extended along an edge of the board body portion from the end portion toward the external space.

5. The heat sensor of claim 2, wherein
the extended portion includes:
a first extended portion extended from the end portion of the board body portion toward the external space; and
a second extended portion arranged symmetrically to the first extended portion with respect to an intersection between the board body portion and a center axis passing through a center of the heat sensor body,
the heat detection unit includes:
a first heat detection unit provided in the first extended portion; and
a second heat detection unit provided in the second extended portion, and
each of the first heat detection unit and the second heat detection unit includes a chip thermistor.

6. The heat sensor of claim 1, wherein
the heat sensor body further includes a cap member arranged between the base and the board,
the heat sensor body includes at least two wall members, at least one of which is the at least one wall member,
when the heat sensor body is viewed in an arrangement direction, two wall members, out of the at least two wall members, and the heat detection unit are arranged along a peripheral edge portion of the cap member, the heat detection unit is located between the two wall members, and the board is located between the two wall members, and
when the heat sensor body is viewed in the arrangement direction, the two wall members are tilted toward the heat detection unit with respect to a line that connects together respective tips of the two wall members located closest to the opening such that the closer to the board the two wall members are, the more distant from the line the two wall members are.

7. The heat sensor of claim 1, wherein
the at least one wall member has such a shape that closes a part of the opening in an arrangement direction and that connects an internal space to the external space through the rest of the opening.

8. The heat sensor of claim 1, wherein
the at least one wall member includes a first surface facing the opening and a second surface facing away from the opening,
the second surface has a different area from the first surface, and
when a cross section of the at least one wall member is viewed in an arrangement direction, the first surface has a greater length than the second surface.

9. The heat sensor of claim 8, wherein the first surface is a raised surface which is convex toward the external space, and the second surface is a plane.

10. The heat sensor of claim 9, wherein when the cross section of the at least one wall member is viewed in the arrangement direction, a vertex of the first surface, at which a dimension between the first surface and the second surface becomes maximum, is located closer to the opening than a middle, at which the second surface is equally divided into two in a direction aligned with the second surface, is.

11. The heat sensor of claim 9, wherein the board includes:

a board body portion forming a body of the board; and an extended portion extended from an end portion of the board body portion toward the external space, the heat detection unit is provided in the extended portion, and an extension of the second surface is located closer to the board body portion than to the heat detection unit.

12. A smoke and heat fire detector comprising a smoke detection unit and configured to determine, based on at least one of a result of detection obtained by the smoke detection unit or a result of detection obtained by the heat detection unit of the heat sensor of claim 1, whether or not a fire is present, the smoke detection unit being provided close to a center of the board of the heat sensor so as to avoid interfering with the heat detection unit and the at least one wall member, the smoke detection unit being configured to determine whether or not a fire is present by sensing, in a space inside a stray light attenuating labyrinth structure, a smoke component that has entered the heat sensor body as a component of the gas.

* * * * *